US006267487B1

(12) United States Patent
Tucker et al.

(10) Patent No.: US 6,267,487 B1
(45) Date of Patent: Jul. 31, 2001

(54) LIGHT HOLDER

(76) Inventors: Peter Tucker; Scott Wilson, both of Unit 4, Lot 1, Cumberland Avenue, Nowra, New South Wales (AU)

( * ) Notice: Subject to any disclaimer, the term of this patent is extended or adjusted under 35 U.S.C. 154(b) by 0 days.

(21) Appl. No.: 09/387,678

(22) Filed: Aug. 31, 1999

(30) Foreign Application Priority Data

Sep. 2, 1998 (AU) ..... PP5653

(51) Int. Cl.[7] ..... A47K 1/08

(52) U.S. Cl. ..... 362/382; 362/398; 362/191; 362/190; 362/396; 248/206.5; 248/313; 248/311.2

(58) Field of Search ..... 362/398, 191, 362/190, 396; 248/206.5, 313, 311.2

(56) References Cited

U.S. PATENT DOCUMENTS 1,932,143 * 10/1933 Piercy ..... 362/398
5,577,697 * 11/1996 Accordino ..... 248/206.5
5,623,769 * 4/1997 Hayden ..... 248/206.5
5,967,345 * 10/1999 Subotin ..... 248/311.2
6,045,017 * 4/2000 Connell ..... 248/311.2
6,062,700 * 5/2000 Price ..... 362/103
6,095,472 * 8/2000 Hubbard et al. ..... 248/313
6,098,860 * 8/2000 Phillips ..... 248/311.2
6,145,796 * 11/2000 McCraney ..... 248/154
6,158,876 * 12/2000 Birdwell ..... 362/208
6,193,202 * 2/2001 Rogers ..... 248/311.2

* cited by examiner

*Primary Examiner*—Stephen Husar
*Assistant Examiner*—Anabel M Ton
(74) *Attorney, Agent, or Firm*—Ladas & Parry

(57) ABSTRACT

A holder (10) to support a portable light. The holder (10) includes a base (11) with a concave surface (14) to receive the light, and adjacent which there is located belts (13) to secure the light to the surface (14). Extending from the base (11) is a bridge portion (18) to which a magnetic portion (15) is attached.

4 Claims, 3 Drawing Sheets

LIGHT HOLDER

TECHNICAL FIELD

The present invention relates to holders to support a light and more particularly, portable lights.

BACKGROUND OF THE INVENTION

Portable lights are used in a wide variety of applications but more particularly, in industry. For example, in the automotive industry, portable lights are used to illuminate areas beneath motor vehicles.

Previously available devices which support portable lights have suffered from the disadvantage that frequently they cannot be secured in a desired position and further, may not be properly support.

OBJECT OF THE INVENTION

It is the object of the present invention to overcome or substantially ameliorate at least one of the above disadvantages.

SUMMARY OF THE INVENTION

There is disclosed herein a holder to support a portable light, said holder including:

a base;

at least one strap attached to the base adapted to pass around the object to secure the object to the base;

a magnetic portion to attach the holder to a steel surface so that the object secured thereto is located adjacent the surface; and a bridge portion attaching the magnetic portion to the base, such that the magnetic portion and said base are spaced from and parallel to one another.

Preferably, the magnetic portion extends in a first direction from the bridge portion and the base extends in a direction opposite to the direction of extension of the magnetic portion.

Preferably, said magnetic portion and said base extend in opposite directions away from said bridge portion.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENT

Figure 1:
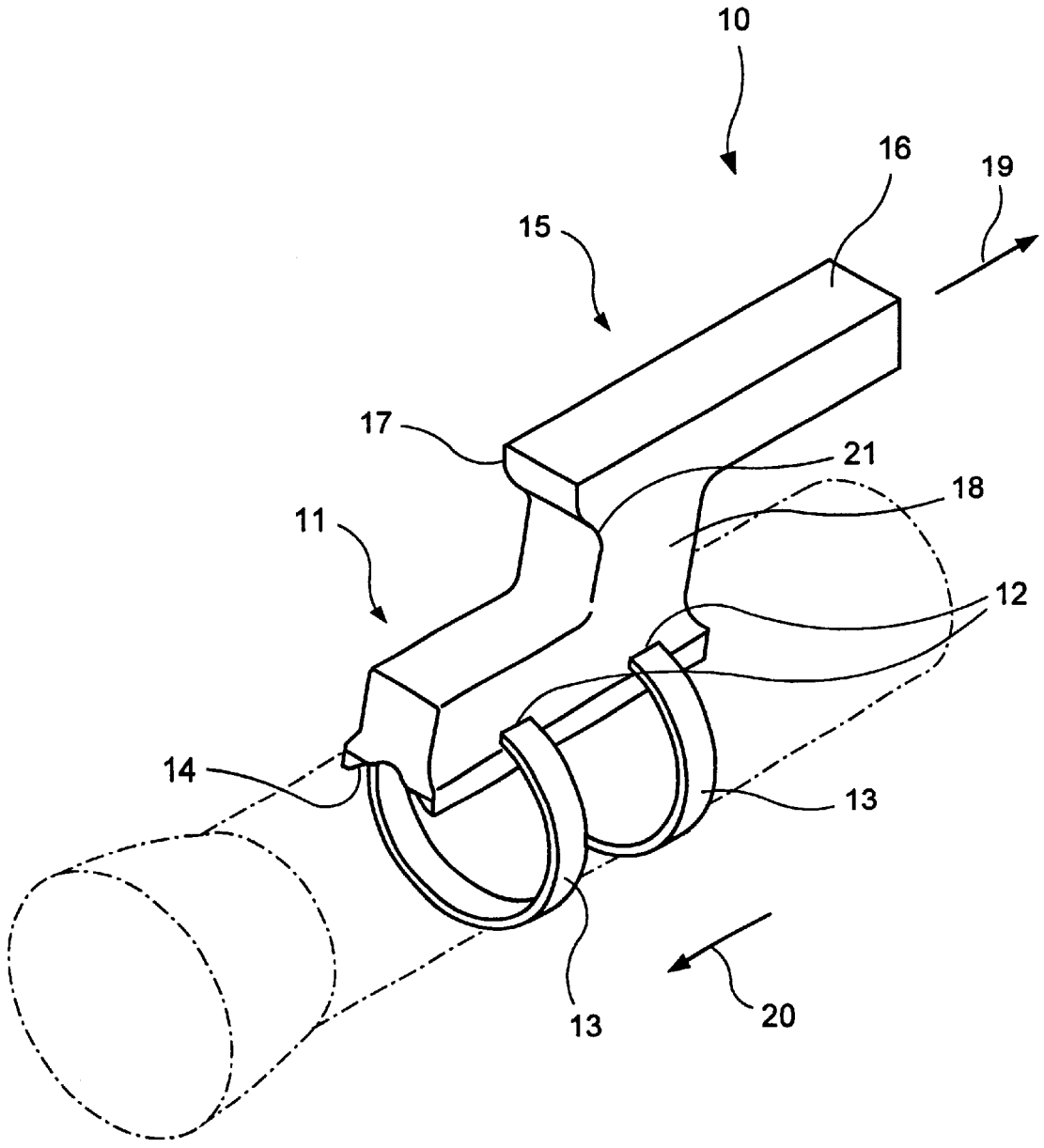
FIG. 1 is a schematic perspective view of a holder to support a portable object such as a portable light.

In FIG. 1 the accompanying drawings there is schematically depicted a holder 10 to support a portable light. The holder 10 includes a base 11 which is elongated and has a pair of apertures 12. Passing through each aperture 12 is belt 13, with the belts 13 being adapted to pass around the portable light to secure the light to the base 11. Preferably, the belts 13 would be adjustable in length. The base 11 has a surface 14, which is concave and adapted to fit against the portable light.

The holder 10 further includes a magnetic portion 15 which would include a magnet. The magnetic may be embedded within the magnet portion 15. The portion 15 includes a generally planar surface 16 and a projection 17.

Extending between the magnetic portion 15 and base 11 is a bridge 18.

The above-mentioned bridge 18 spaces the base 11 from the magnetic portion 15. More particularly, the magnetic portion 15 extends in the direction of the arrow 19 from the bridge 18, while the base 11 extends in the direction of the arrow 20 from the bridge 18.

Preferably, the above-mentioned holder would be moulded from plastics material with the magnetic embedded therein. Typically, the straps 13 would be formed of plastics material and may have overlapping end portions provided with velcro or similar fastening materials so that the effective diameter defined by the belts 13 is adjustable to suit lights of different sizes.

Preferably, the projection 17 defines a step 21 adjacent the bridge 18.

Figure 2:
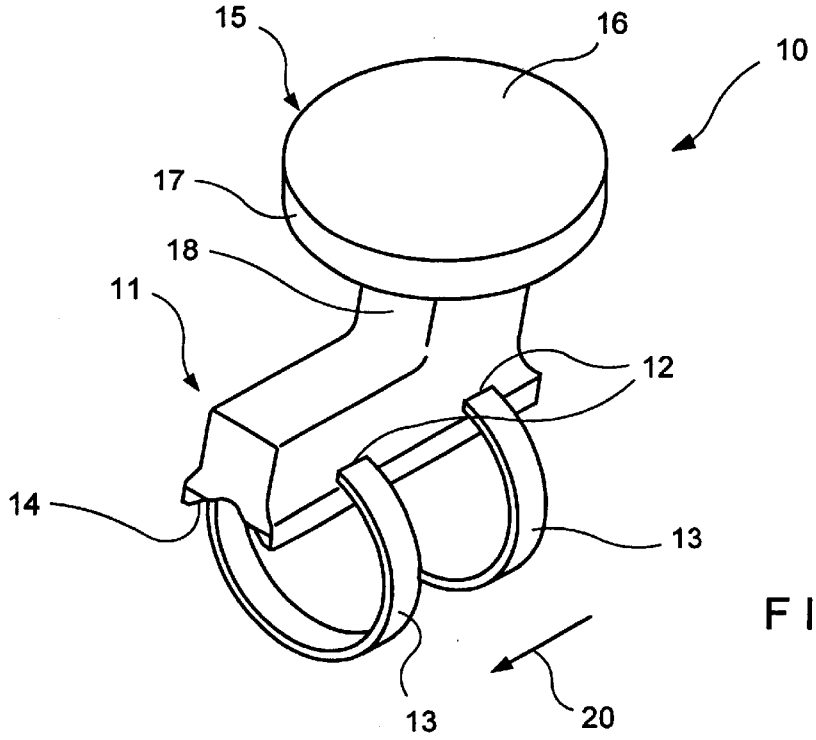
FIG. 2 is a schematic perspective view of a modification of the holder of FIG. 1.

In the embodiment of FIG. 2, the magnetic portion 15 is of a generally circular configuration.

Figure 3:
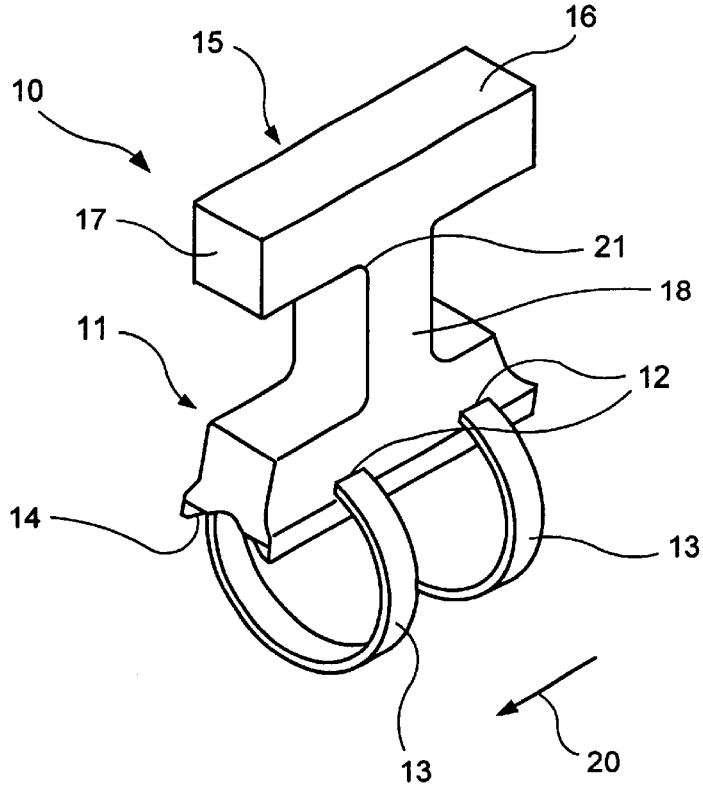
FIG. 3 is a schematic perspective view of a further modification of the holder of FIG. 1.

In the embodiment of FIG. 3, the base 11 and magnetic portion 15 are generally parallel and the bridge 18 generally perpendicular thereto.

Figure 4:
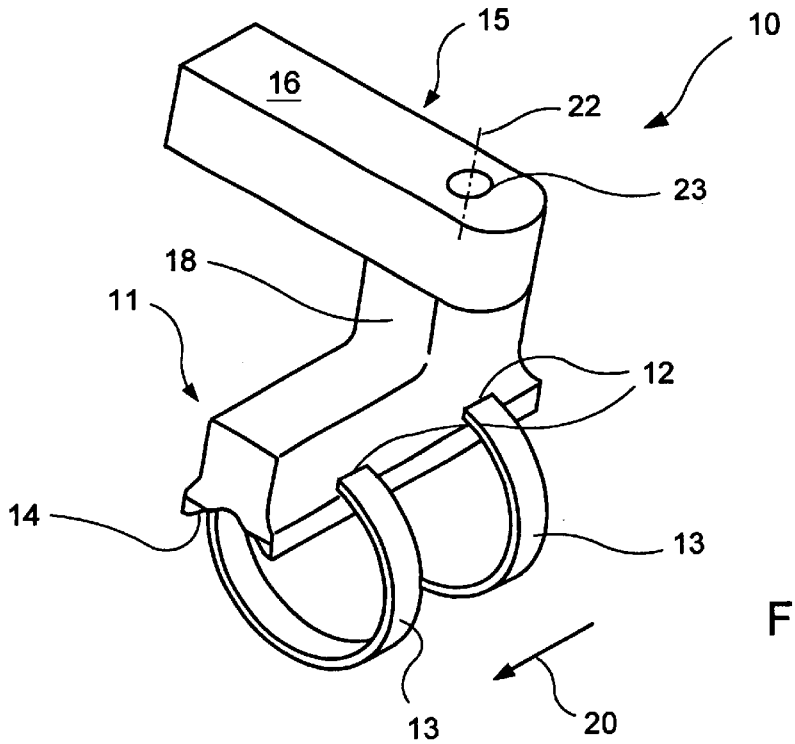
FIG. 4 is a schematic perspective view of a still further modification of the holder of FIG. 1.

In the embodiment of FIG. 4, the magnetic portion 15 is attached to the neck 18 by means of a pivot pin 23 which enables the magnetic portion 15 to pivot about the axis 22.

Figure 5:
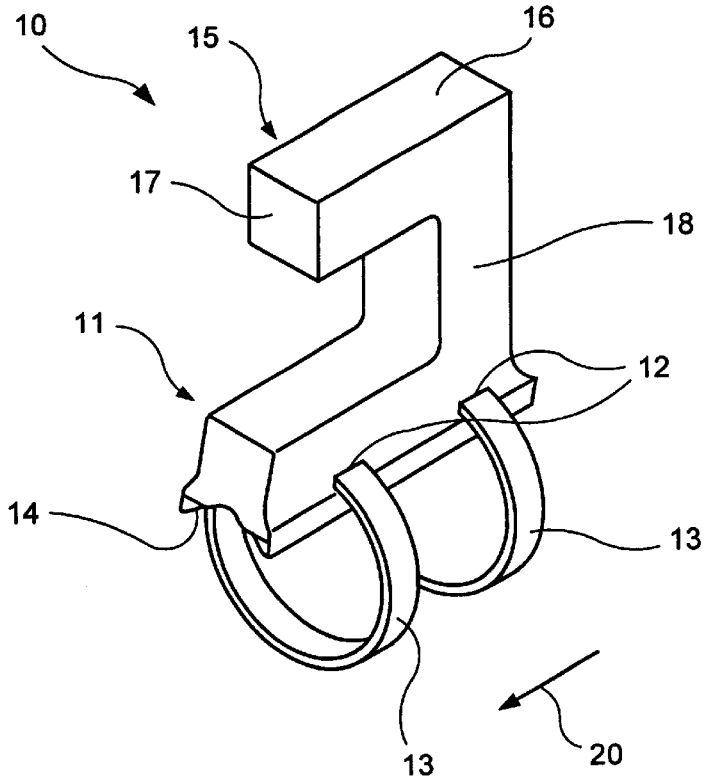
FIG. 5 is a schematic perspective view of yet a further modification of the holder of FIG. 1.

In the embodiment of FIG. 5, the magnetic portion 15 projects from the bridge 18 in the direction of the arrow 20. The base 11 is generally parallel to the magnetic portion 15, with the bridge 18 being generally perpendicular thereto.

The above described preferred embodiments have been described by way of example with reference to a portable light.

It should be appreciated that the holder 10 can support any portable object such as a tradesman's tool, a cordless (mobile) phone or even aerosol cans.

The claims defining the invention are as follows:

1. A holder for supporting a portable light, said holder including:

a substantially rectangular elongate base defining a longitudinal axis, said base comprising:

a pair of apertures extending through said base substantially normal to said axis;

a concave lower surface adapted to receive and retain said light; and a pair of adjustable straps passing through said apertures and adapted to pass completely around said light for securing said light in said concave surface of said base;

an elongate magnetic portion to attach the holder to a steel surface so that the light secured thereto is located adjacent a work surface; and a bridge portion attaching the magnetic portion to the base such that the magnetic portion and said base are spaced from and extend parallel to one another.

2. The holder of claim 1, wherein said holder is an integrally formed plastic holder.

3. The holder of claim 1, wherein said magnetic portion and said base extend in opposite directions away from said bridge portion.

4. The holder of claim 2, wherein said magnetic portion and said base extend in opposite directions away from said bridge portion.

* * * * *